US009759094B2

(12) United States Patent
Hutto, Jr.

(10) Patent No.: US 9,759,094 B2
(45) Date of Patent: Sep. 12, 2017

(54) PUMP FOR A TURBINE ENGINE

(71) Applicant: GENERAL ELECTRIC COMPANY, Schenectady, NY (US)

(72) Inventor: Walter Decania Hutto, Jr., Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 240 days.

(21) Appl. No.: 14/748,505

(22) Filed: Jun. 24, 2015

(65) Prior Publication Data

US 2016/0376923 A1 Dec. 29, 2016

(51) Int. Cl.

| | |
|---|---|
| ***F01D 25/20*** | (2006.01) |
| ***F01D 25/16*** | (2006.01) |
| ***F01D 25/18*** | (2006.01) |
| ***F04D 29/056*** | (2006.01) |
| ***F04D 29/063*** | (2006.01) |
| ***F04D 29/32*** | (2006.01) |

(52) U.S. Cl.

CPC ..... *F01D 25/20* (2013.01); *F01D 25/16* (2013.01); *F01D 25/18* (2013.01); *F04D 29/056* (2013.01); *F04D 29/063* (2013.01); *F04D 29/321* (2013.01); *F05D 2220/323* (2013.01); *F05D 2260/98* (2013.01)

(58) Field of Classification Search

CPC ..... F16N 2210/02; F01M 11/067; F01M 2001/123; F01D 25/20; F01D 25/16; F01D 25/18; F04D 29/056; F04D 29/063; F04D 29/321; F05D 2220/323; F05D 2260/98; F02C 7/30; F02C 7/32

See application file for complete search history.

(56) References Cited

U.S. PATENT DOCUMENTS

| | | | |
|---|---|---|---|
| 2,263,414 | A | 11/1941 | Beneshek et al. |
| 2,487,439 | A | 11/1949 | Hasbrouck |
| 2,609,065 | A | 9/1952 | Douglas |
| 3,576,143 | A | 4/1971 | Baits |

(Continued)

FOREIGN PATENT DOCUMENTS

| | | | |
|---|---|---|---|
| EP | 1722074 | A2 | 11/2006 |
| JP | 2010-538888 | A | 12/2010 |
| WO | 2015047577 | A1 | 4/2015 |

OTHER PUBLICATIONS

European Search Report and Opinion issued in connection with corresponding EP Application No. 16166070.9 dated Nov. 3, 2016.

(Continued)

*Primary Examiner* — Dwayne J White
*Assistant Examiner* — Justin Pruitt
(74) *Attorney, Agent, or Firm* — Pamela A. Kachur

(57) ABSTRACT

A pump for a gas turbine engine is provided. The pump includes a first drive track having a spline and a first gear each rigidly attached to a first driveshaft. The pump also includes a second drive track having a second gear rigidly attached to a second driveshaft. The second gear is mechanically coupled to the first gear. Additionally, a first lubrication supply pump is mechanically coupled to the first driveshaft and a second lubrication supply pump is mechanically coupled to the second driveshaft. The first and second lubrication supply pumps are together configured to provide a desired amount of lubrication to the gas turbine engine.

20 Claims, 4 Drawing Sheets

(56) References Cited

U.S. PATENT DOCUMENTS

| | | | | |
|---|---|---|---|---|
| 3,722,212 | A | 3/1973 | Stein | |
| 4,002,224 | A | 1/1977 | Easter | |
| 4,715,244 | A | 12/1987 | Byrd et al. | |
| 5,196,746 | A | 3/1993 | McCabria | |
| 5,845,483 | A * | 12/1998 | Petrowicz | F02C 7/262 60/39.163 |
| 6,463,819 | B1 * | 10/2002 | Rago | B64D 37/22 137/112 |
| 8,210,316 | B2 | 7/2012 | DiBenedetto et al. | |
| 8,230,835 | B2 | 7/2012 | Gibson et al. | |
| 2005/0166570 | A1 * | 8/2005 | Granitz | F01D 25/18 60/39.08 |
| 2008/0178833 | A1 | 7/2008 | Restivo et al. | |
| 2010/0156113 | A1 * | 6/2010 | Lemmers, Jr. | F02C 7/32 290/1 C |
| 2014/0090930 | A1 | 4/2014 | James | |
| 2014/0174858 | A1 | 6/2014 | Remer et al. | |

OTHER PUBLICATIONS

Notification of Reasons for Refusal issued in connection with corresponding JP Application No. 2016-081599 dated Apr. 4, 2017.

* cited by examiner

PUMP FOR A TURBINE ENGINE

STATEMENT REGARDING FEDERALLY SPONSORED RESEARCH & DEVELOPMENT

The US Government may have certain rights in this invention pursuant to Contract No. FA 8650-09-D2922 awarded by the US Department of the Air Force.

FIELD OF THE INVENTION

The present subject matter relates generally to a pump for a gas turbine engine, or more particularly to a pump having redundant pump features.

BACKGROUND OF THE INVENTION

Certain gas turbine engines, such as aircraft gas turbine engines, include one or more rotating shafts that support compression and turbine aerodynamic turbomachinery. The one or more shafts require bearings to support thrust loads and radial loads imposed during operation. The bearings are housed in enclosures generally referred to as sumps. Gas turbine engines typically have a forward sump, a mid sump, and an aft sump. Additionally, certain gas turbine engines will contain an accessory drive gearbox with numerous gear meshes and shafts requiring supporting bearings. The shaft and gearbox bearings and gear meshes require continuous lubrication during operation. Additionally, lubrication must be scavenged from each of the lubrication sites and pumped back to a lubrication reservoir/oil tank for reuse.

A pumping element is typically included to provide lubrication to the various bearings and gear meshes, as well as to scavenge the lubrication from the respective sumps. Failure of the pumping element can result in termination of lubrication flow to all critical locations and failure of a scavenge element can result in flooding of the affected site. Flooding of the affected site can, in turn, result in depletion of lubrication in the reservoir and subsequent bearing failure and seizure. Such a failure may be of a particular safety concern in, for example, single engine aircraft applications.

Accordingly, a more robust pump would be beneficial. More particularly, a pump for a gas turbine engine having one or more redundant features such that the pump may continue operating subsequent to a failure would be particularly useful.

BRIEF DESCRIPTION OF THE INVENTION

Aspects and advantages of the invention will be set forth in part in the following description, or may be obvious from the description, or may be learned through practice of the invention.

In one exemplary embodiment a pump for a gas turbine engine is provided. The pump includes a first drive track including a first driveshaft, a spline, and a first gear. The spline and the first gear are each rigidly attached to the first driveshaft. The pump also includes a second drive track including a second driveshaft and a second gear. The second gear is rigidly attached to the second driveshaft and is mechanically coupled to the first gear. The pump also includes a first lubrication supply pump mechanically coupled to the first driveshaft, and a second lubrication supply pump mechanically coupled to the second driveshaft. The first lubrication supply pump and second lubrication supply pump are together configured to provide a desired amount of lubricant to the gas turbine engine.

In another exemplary embodiment, a gas turbine engine is provided. The gas turbine engine includes a compressor section, a turbine section mechanically coupled to the compressor section, and a pump. The pump includes a first drive track including a first driveshaft, a spline, and a first gear. The spline and the first gear are each rigidly attached to the first driveshaft. The pump also includes a second drive track including a second driveshaft and a second gear. The second gear is rigidly attached to the second driveshaft and is mechanically coupled to the first gear. The pump also includes a first lubrication supply pump mechanically coupled to the first driveshaft, and a second lubrication supply pump mechanically coupled to the second driveshaft. The first lubrication supply pump and second lubrication supply pump are together configured to provide a desired amount of lubricant to the gas turbine engine.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
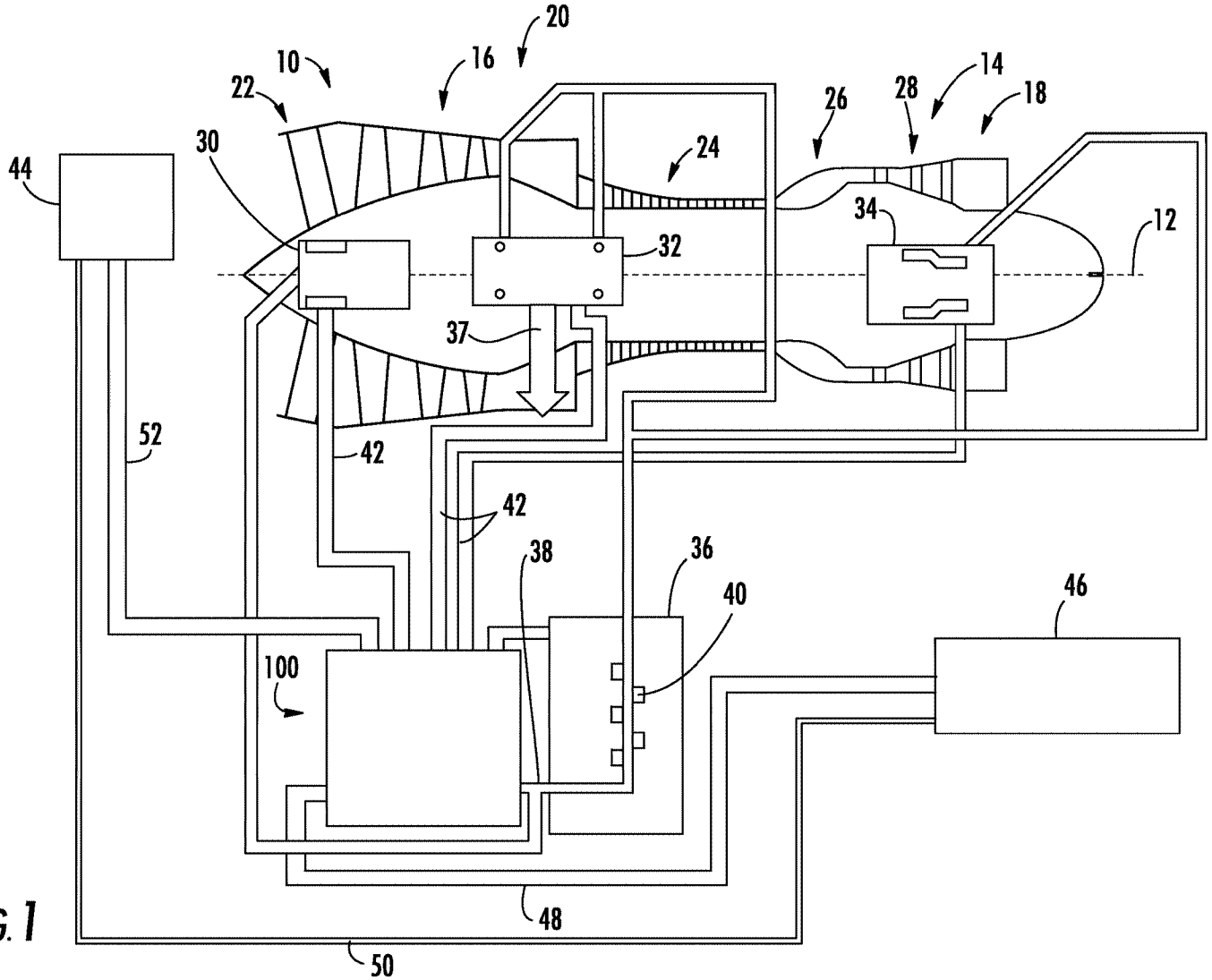
FIG. 1 is a schematic cross-sectional view of an exemplary gas turbine engine according to various embodiments of the present subject matter.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Referring now to the drawings, wherein identical numerals indicate the same elements throughout the figures, FIG. 1 is a schematic cross-sectional view of a gas turbine engine in accordance with an exemplary embodiment of the present disclosure. More particularly, for the embodiment of FIG. 1, the gas turbine engine is an aeronautical gas turbine engine 10, referred to herein as "gas turbine engine 10." It should be appreciated, however, that the embodiment depicted in FIG. 1 is by way of example only. In other exemplary embodiments, for example, aspects of the present disclosure may be incorporated into any suitable gas turbine engine. For example, in other exemplary embodiments, aspects of the present disclosure may be incorporated into any suitable turbofan engine, turbojet engine, turboshaft engine, turboprop engine, etc.

As shown in FIG. 1, the gas turbine engine 10 generally defines a longitudinal centerline 12, and includes a core 14 extending between a forward portion 16 and an aft portion 18 along the longitudinal centerline 12. Additionally, the gas turbine engine 10 includes in serial flow relationship, a compressor section 20 including a low pressure (LP) compressor 22 and a high pressure (HP) compressor 24; a combustion section 26; and a turbine section 28. One or more shafts (not shown) may be provided to drivingly connect aspects of the compressor section 20 and the turbine section 28.

A plurality of bearings are included within the gas turbine engine 10 to support the one or more shafts. Such bearings and gears are enclosed generally in a forward sump 30, a middle sump (or "mid" sump) 32, and an aft sump 34. Additionally, for the embodiment depicted, an accessory gear box ("AGB") 36 is provided. The AGB 36 may be in mechanical communication with the one or more shafts, as indicated by arrow 37. The AGB 36 includes a plurality of bearings and gear meshes and is used to power various components of the engine 10 and an aircraft.

A gas turbine engine lubrication and scavenge pump 100 (referred to herein as "pump") is included to provide lubrication to the various shafts, bearings, and gear meshes, as well as to scavenge lubrication from the forward sump 30, mid sump 32, aft sump 34, and AGB 36. For example, as is depicted schematically, the pump 100 is fluidly connected to an outlet line 38, which splits off in various locations to provide lubrication to the various bearings and gears in the forward sump 30, in the AGB 36 (through a plurality of nozzles 40), in the mid sump 32, and in the aft sump 34. Additionally, the pump 100 is in fluidly connected to a plurality of scavenge lines 42 for returning the lubrication from the forward sump 30, the mid sump 32, the aft sump 34, and the AGB 36. It should be appreciated, however, that although a single scavenge line 42 is depicted for returning lubrication from each of the various sumps, in other exemplary embodiments, a plurality of scavenge lines may instead be provided.

As is also depicted in FIG. 1, the pump 100 is fluidly connected to a tank 44 and a heat exchanger 46. The pump 100 may be configured to provide the scavenged lubrication through a line 48 to the heat exchanger 46, where at least a certain amount of heat may be removed from the lubrication. The cooled lubrication may then be provided through a line 50 the tank 44. The lubrication may remain in the tank 44 until the pump 100 pulls such lubrication from the tank 44 via a line 52 and pumps such lubrication back to the various components of the engine 10.

Although not depicted, the operation of the gas turbine engine 10 may be monitored by several sensors, such as pressure and/or temperature sensors, detecting various conditions of, e.g., the compressor section 20, the turbine section 28, combustion section 26, and/or the ambient environment. Additionally, a controller may be included to control certain aspects of the gas turbine engine 10. The controller may generally be any turbine engine control system known in the art that permits a turbine engine to be controlled and/or operated as described herein. Generally, the controller may include any computer system having one or more processor(s) and associated memory device(s) configured to perform a variety of computer-implemented functions to control the gas turbine engine 10.

Figures 2, 3:
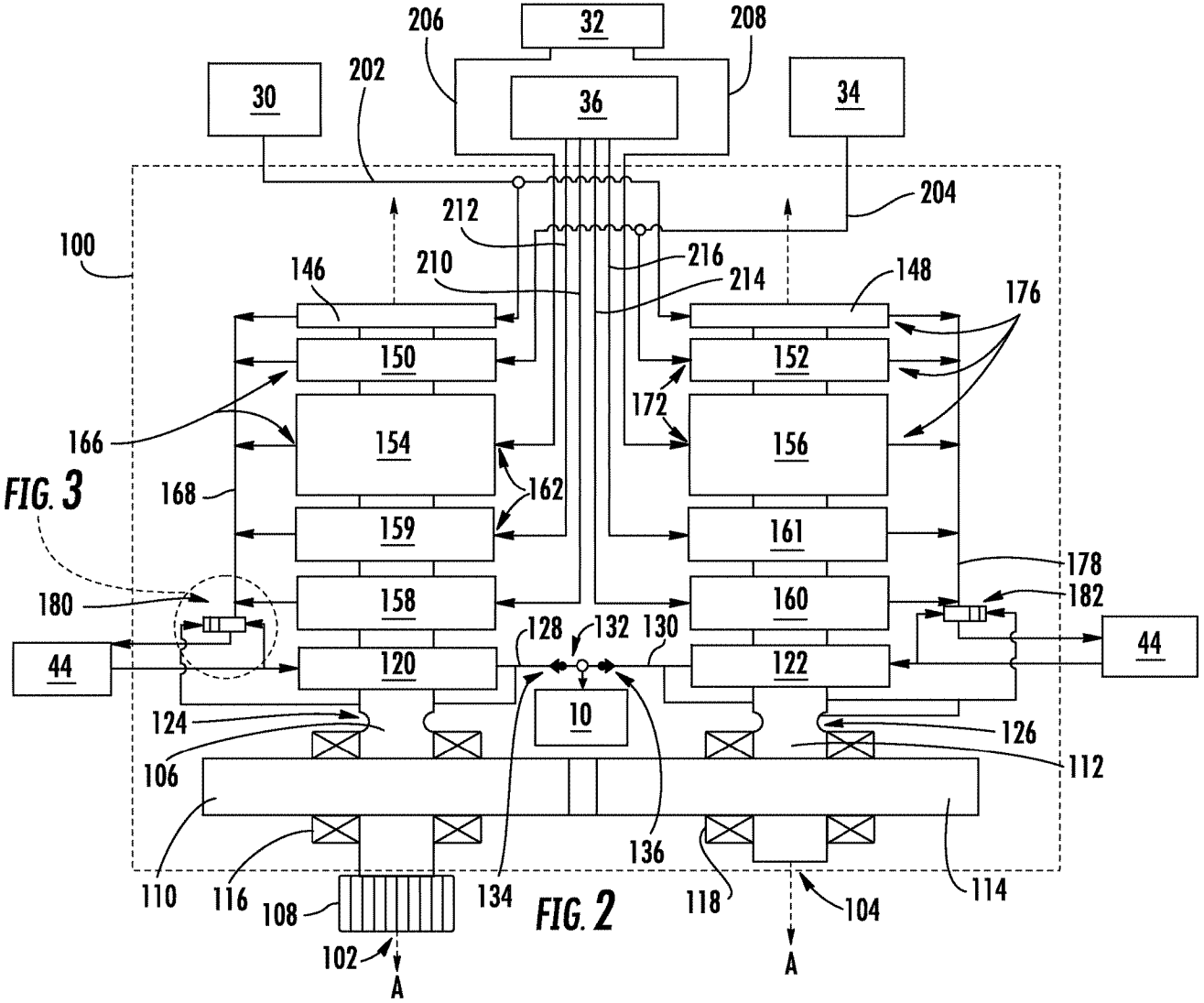
FIG. 2 is a schematic view of a pump in accordance with an exemplary embodiment of the present disclosure.
FIG. 3 is a schematic view of a first return valve in accordance with an exemplary embodiment of the present disclosure included within the exemplary pump of FIG. 2 in a closed position.
Figure 3:
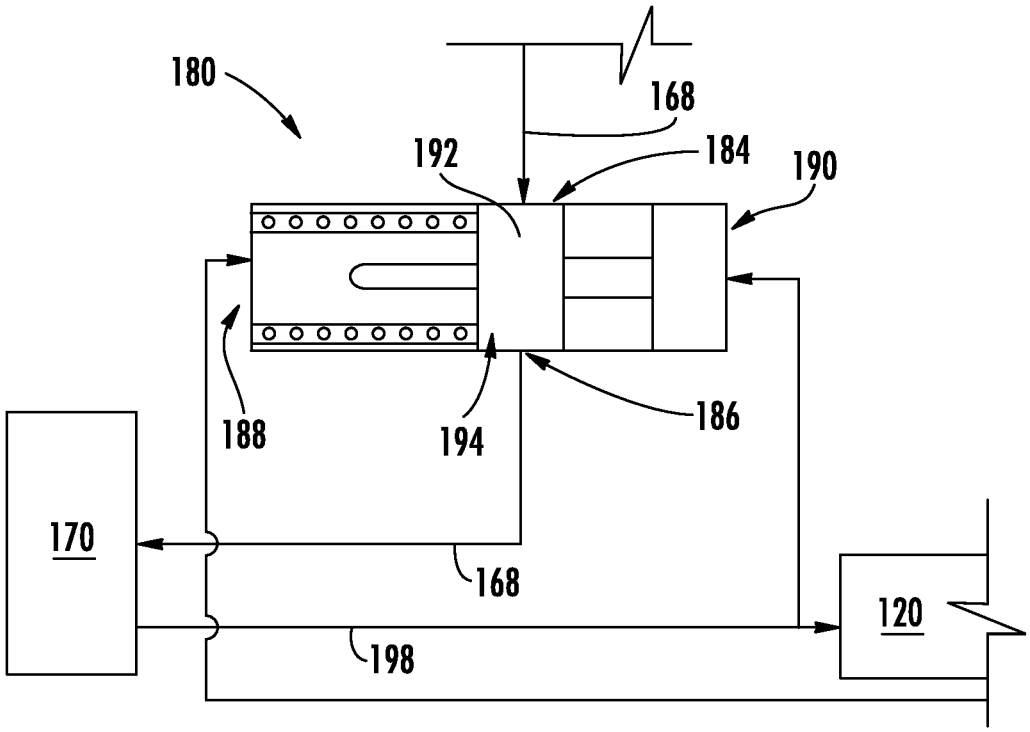

Referring now to FIG. 2, a schematic view of the exemplary gas turbine engine lubrication and scavenge pump (referred to herein as "pump") 100 is provided along with a schematic view of the exemplary gas turbine engine 10 of FIG. 1.

As shown, the exemplary pump 100 of FIG. 2 generally includes a first drive track 102 and a second drive track 104. The first drive track 102 includes a first driveshaft 106 extending along an axial direction $A_1$, a spline 108, and a first gear 110. The spline 108 is rigidly attached to the first driveshaft 106, such that during operation of the pump 100, the first driveshaft 106 is rotated about the axial direction $A_1$ by the spline 108. Additionally, the spline 108 may be in mechanical communication with one or more components of the core engine of the gas turbine engine 10, such as the one or more shafts. The first gear 110 is also rigidly attached to the first driveshaft 106.

The second drive track 104 is configured in a similar manner to the first drive track 102. For example, the second drive track 104 includes a second driveshaft 112 extending along an axial direction $A_2$ and a second gear 114. The second gear 114 is rigidly attached to the second driveshaft 112 and is also mechanically coupled to the first gear 110 of the first drive track 102. Accordingly, rotation of the spline 108 and first driveshaft 106 about the axial direction $A_1$ correspondingly rotates the first gear 110, which in turn rotates the second gear 114 and second driveshaft 112 about the axial direction $A_2$.

For the embodiment depicted, the first drive track 102 is configured in parallel with the second drive track 104—i.e., the axial direction $A_1$ is substantially parallel to the axial direction $A_2$. Accordingly, for the embodiment depicted, the first gear 110 may be a first spur gear and the second gear 114 may be a second spur gear. The first and second gears 110, 114 are substantially the same size, such that the first and second gears 110, 114 define a gear ratio of about 1:1. As used herein, terms of approximation, such as "about" and "substantially," refer to being within a ten percent margin of error. Additionally, for the embodiment depicted the first drive track 102 is supported by a plurality of bearings 116 positioned adjacent to the first gear 110, and the second drive track 104 is supported by a plurality of bearings 118 positioned adjacent to the second gear 114. The bearings 116, 118 may be line contact bearings, roller bearings, or combination of roller bearings and line contact bearings. The bearings 116, 118 may ensure the first driveshaft 106 and second driveshaft 112 remain in a desired position and orientation throughout operation of the pump 100.

It should be appreciated, however, that in other exemplary embodiments, the first and second drive tracks 102, 104 may alternatively define an angle relative to one another and/or the first and second gears 110, 114 may define a gear ratio greater than or less than about 1:1. It should also be appreciated that in other exemplary embodiments, the first and second drive tracks 102, 104 may additionally, or alternatively, be supported in any other suitable manner. For example, in other exemplary embodiments, the first drive track 102 and/or the second drive track 104 may include additional bearings 116, 118 positioned adjacent to the first driveshaft 106 and/or the second driveshaft 112, respectively, at any suitable location along the axial direction $A_1$ and/or the axial direction $A_2$.

Referring still to FIG. 2, the exemplary pump 100 further includes a first lubrication supply pump 120 mechanically coupled to the first driveshaft 106 and a second lubrication supply pump 122 mechanically coupled to the second driveshaft 112. During normal operation of the gas turbine engine 10 and the exemplary pump 100, the first lubrication supply pump 120 and second lubrication supply pump 122 are together configured to provide a desired amount of lubricant to the gas turbine engine 10. As used herein, the term "desired amount" with reference to an amount of lubricant provided to the gas turbine engine 10 (or removed from one or more sumps of the gas turbine engine 10, discussed below) refers to an amount of lubricant necessary to allow the gas turbine engine 10 to operate safely during all normal operating modes (e.g., high power output, low power output, landing, takeoff, etc.). For example, the first lubrication supply pump 120 and second lubrication supply pump 122 are together configured to provide the gas turbine engine 10 a volume of lubricant necessary to operate the gas turbine engine 10 during all operation modes. Additionally, although the gas turbine engine 10 is depicted schematically in FIG. 2 as a box within the pump 100 for clarity, as stated above, the pump 100 may be positioned at any suitable location for providing lubricant to the gas turbine engine 10. For example, in certain exemplary embodiments, the pump 100 may be positioned within the core 14 of the gas turbine engine 10, or at any suitable location near or adjacent to the core 14 of the gas turbine engine 10.

More particularly, for the embodiment depicted, the first lubrication supply pump 120 is configured to provide the gas turbine engine 10 up to about half of a desired amount of lubricant during normal operation of the gas turbine engine 10. Additionally, the second lubrication supply pump 122 is also configured to provide the gas turbine engine 10 up to about half of the desired amount of lubricant during normal operation of the gas turbine engine 10. Accordingly, should one of the first drive track 102 or second drive track 104 fail, the pump 100 may still be capable of providing the gas turbine engine 10 with at least a portion of a desired amount of lubricant. Thus, for the embodiment depicted, wherein the gas turbine engine 10 is an aeronautical gas turbine engine, the present gas turbine engine 10 may continue to operate at, e.g., a reduced power level, despite a failure of one of the first drive track 102 or the second drive track 104 of the pump 100. For example, a controller of the gas turbine engine 10 may determine when one of the first drive track 102 or second drive track 104 has failed and, e.g., restrict certain operations of the gas turbine engine 10.

Notably, the exemplary pump 100 includes additional features to allow the pump 100 to continue to provide the gas turbine engine 10 with at least a portion of the desired amount of lubricant should one of the first drive track 102 or second drive track 104 fail. For example, the first driveshaft 106 of the first drive track 102 includes a shear section 124 positioned between the first lubrication supply pump 120 and the first gear 110 and spline 108. Accordingly, should the first driveshaft 106 fail, it will likely fail at the shear section 124 such that the spline 108 and the first gear 110 will continue to drive the second gear 114 and second drive track 104. Similarly, the second driveshaft 112 also includes a shear section 126. The shear section 126 of the second driveshaft 112 is positioned between the second lubrication supply pump 122 and the second gear 114. Accordingly, should the second driveshaft 112 fail, it will likely fail at the shear section 126 such that the first gear 110 and first drive track 102 will not be disturbed. Thus, due at least in part to the support provided by the bearings 116, 118, the failure of either the first driveshaft 106 or the second driveshaft 112 at a respective shear section 124, 126, will have no adverse effect on the remaining driveshaft and drive track. For the embodiment depicted, the shear sections 124, 126 of the first driveshaft 106 and second driveshaft 112 are each areas of reduced cross-sectional thickness. However, in other exemplary embodiments, the shear sections 124, 126 of the first and second driveshafts 110, 112 may have any other suitable configuration for inducing a failure at a particular location.

Additionally, as may be seen in FIG. 2, the pump 100 generally includes a first lubrication supply line 128 and a second lubrication supply line 130. The first lubrication supply line 128 is fluidly connected to the first lubrication supply pump 120 for providing a flow of lubricant from the first lubrication supply pump 120 to the gas turbine engine 10. Similarly, the second lubrication supply line 130 is fluidly connected to the second lubrication supply pump 122 for providing a flow of lubricant from the second lubrication supply pump 122 to the gas turbine engine 10. For the embodiment depicted, the first lubrication supply line 128 and second lubrication supply line 130 meet at a juncture 132, such that lubrication from the first and second lubrication supply pumps 120, 122 may be provided to the gas turbine engine 10 through a single supply line (such as outlet line 38 in FIG. 1).

Further, the exemplary pump 100 depicted includes a first check valve 134 positioned in the first lubrication supply line 128 and a second check valve and 136 positioned in the second lubrication supply line 130. The first check valve 134 is configured to block a flow of lubricant from the gas turbine engine 10, through the first lubrication supply line 128, towards the first lubrication supply pump 120. Similarly, the second check valve 136 is configured to block a flow of lubricant from the gas turbine engine 10, through the second lubrication supply line 130, towards the second lubrication supply pump 122. Accordingly, should one of the first drive track 102 or second drive track 104 fail, the still-operating lubrication supply pump will not pump lubricant through the lubrication supply line of the non-operating lubrication supply pump.

In addition to the redundant configuration of lubrication supply pumps 120, 122 for providing lubrication to the gas turbine engine 10, the exemplary pump 100 of FIG. 2 includes a similar redundant configuration for returning the lubrication from the gas turbine engine 10. More particularly, the exemplary gas turbine engine 10 depicted includes a plurality of sumps positioned at least partially in, e.g., the compressor section 20 and/or the turbine section 28 of the core 14 of the gas turbine engine 10 (see FIG. 1). Specifically, as discussed above with reference to FIG. 1, the exemplary gas turbine engine 10 includes the forward sump 30, the middle sump 32, the aft sump 34, and the AGB 36. Additionally, the exemplary pump 100 includes a corresponding first plurality of scavenge pumps mechanically coupled to the first driveshaft 106 of the first drive track 102, and a corresponding second plurality of scavenge pumps mechanically coupled to the second driveshaft 112 of the second drive track 104. Each of the first plurality of scavenge pumps are fluidly connected to one of the plurality of sumps 30, 32, 34, 36 and are configured to remove a portion of a desired amount of lubricant from a respective sump. Similarly, each of the second plurality of scavenge pumps are also fluidly connected to one of the plurality of sumps 30, 32, 34, 36 and are also configured to remove a portion of the desired amount of lubricant from a respective sump. For example, in the embodiment depicted, certain of the first plurality of scavenge pumps are configured to remove up to about half of a desired amount of lubricant from a respective sump, and certain of the second plurality of scavenge pumps are also configured to remove up to about half of a desired amount of lubricant from a respective sump. Thus, certain scavenge pumps in the first plurality of scavenge pumps are configured to remove a desired amount of lubrication from a respective sump together with a corresponding scavenge pump in the second plurality of scavenge pumps.

Referring particularly to the exemplary embodiment of FIG. 2, the exemplary pump 100 includes a first forward scavenge pump 146 mechanically coupled to the first driveshaft 106 and a second forward scavenge pump 148 mechanically coupled to the second driveshaft 112. The first and second forward scavenge pumps 146, 148 are each in fluid communication with the forward sump 30 of the gas turbine engine 10 via a scavenge line 202 (which, as shown, splits into two separate lines, each leading to one of the first or second forward scavenge pumps 146, 148) and are together configured for removing a desired amount of lubricant from the forward sump 30 of the gas turbine engine 10. For example, in certain embodiments the first forward scavenge pump 146 is configured to remove up to about half of a desired amount of lubricant from the forward sump 30 and the second forward scavenge pumps 148 is also configured to remove up to about half of a desired amount of lubricant from the forward sump 30.

The exemplary pump 100 depicted also includes similar scavenge pumps for the additional sumps depicted. For example, the exemplary pump 100 includes: a first and second aft scavenge pump 150, 152 mechanically coupled to the first and second driveshafts 106, 112, respectively; and a first and second middle scavenge pump 154, 156 mechanically coupled to the first and second driveshafts 106, 112, respectively. The first and second aft scavenge pumps 150, 152 are each configured in fluid communication with the aft sump 34 and are together configured for removing a desired amount of lubricant from the aft sump 34 via a scavenge line 204 (which, as shown, also splits into two separate lines, each leading to one of the first or second aft scavenge pumps 150, 152). Additionally, the first and second middle scavenge pumps 154, 156 are configured in fluid communication with a first lubrication exit and a second lubrication exit, respectively, of the middle sump 32 via respective independent scavenge lines 206, 208. The first and second middle scavenge pumps 154, 156 are together configured for removing a desired amount of lubricant from the middle sump 32.

Further, for the embodiment depicted, the exemplary pump 100 additionally includes a first pair of AGB scavenge pumps 158, 159 attached to the first driveshaft 106 and a second pair of AGB scavenge pumps 160, 161 attached to the second driveshaft 112. The first pair of AGB scavenge pumps 158, 159 are fluidly connected to a first lubrication exit and a second lubrication exit, respectively, of the AGB 36 via respective independent scavenge lines 210, 212. Similarly, the second pair of AGB scavenge pumps 160, 161 are fluidly connected to a third lubrication exit and a fourth lubrication exit, respectively, of the AGB 36 via respective independent scavenge lines 214, 216. The first pair of AGB scavenge pumps 158, 159 and second pair of AGB scavenge pumps 160, 161 are together configured for removing a desired amount of lubricant from the AGB 36.

It should be appreciated, that for the embodiment depicted, four individual scavenge lines 210, 212, 214, 216 extend between each of the four AGB scavenge pumps 158, 159, 160, 161 and one of four AGB lubrication exits. Similarly, two individual scavenge lines 206, 208 extend between each of the two middle scavenge pumps 154, 156 and one of two middle sump lubrication exits. Inclusion of multiple independent scavenge lines and lubrication exits in the AGB 36 and middle sump 32 may allow for scavenging of lubrication from the AGB 36 and middle sump 32 at various flight attitudes. More particularly, such a configuration may allow for scavenging of lubrication from the AGB 36 and middle sump 32 when, for example, an aircraft including the exemplary gas turbine engine 10 is in a climb (i.e., incline), in a dive (i.e., decline), or cruising.

Each of the first plurality of scavenge pumps include an inlet 162 fluidly connected to a respective scavenge line 202, 204, 206, 210, 212 and an outlet 166 fluidly connected to a first return line 168. The scavenge lines 202, 204, 206, 210, 212 are each configured to fluidly connect the inlet 162 of a respective scavenge pump of the first plurality of scavenge pumps to a respective sump. Additionally, the first return line 168 is configured for fluidly connecting the outlet 166 of a respective scavenge pump of the first plurality of scavenge pumps to the tank 44 of the exemplary gas turbine engine 10.

Similarly, each of the second plurality of scavenge pumps include an inlet 172 fluidly connected to a respective scavenge line 202, 204, 208, 214, 216 and an outlet 176 fluidly connected to a second return line 178. The scavenge lines 202, 204, 208, 214, 216 are each configured to fluidly connect the inlet 172 of a scavenge pump of the second plurality of scavenge pumps to a respective sump. Additionally, the second return line 178 is configured for fluidly connecting the outlet 176 of the scavenge pump of the second plurality of scavenge pumps to the tank 44 of the gas turbine engine 10.

The tank 44 is configured to receive scavenged lubrication from the first plurality of scavenge pumps and from the second plurality of scavenge pumps. Additionally, the tank 44 is configured to provide such scavenged lubrication to the first lubrication supply pump 120 and/or to the second lubrication supply pump 122. Although depicted schematically as two separate tanks 44 for clarity, in certain exemplary embodiments, the pump 100 may only include a single lubrication tank 44 (see FIG. 1).

As stated, the exemplary pump 100 depicted further includes features to allow the pump 100 to remove at least a portion of a desired amount of lubricant from the plurality of sumps in the event of a failure of one of the first drive track 102 or second drive track 104. For example, the exemplary pump 100 further includes a first return valve 180 positioned in fluid communication with the first return line 168 and a second return valve 182 in fluid communication with the second return line 178. The first return valve 180 is movable between an open position, allowing a flow of fluid through the first return line 168, and a closed position, blocking a flow of fluid through the first return line 168. Similarly, the second return valve 182 is also movable between an open position, allowing a flow of fluid through the second return line 178, and a closed position, blocking a flow of fluid through the second return line 178.

Figure 4:
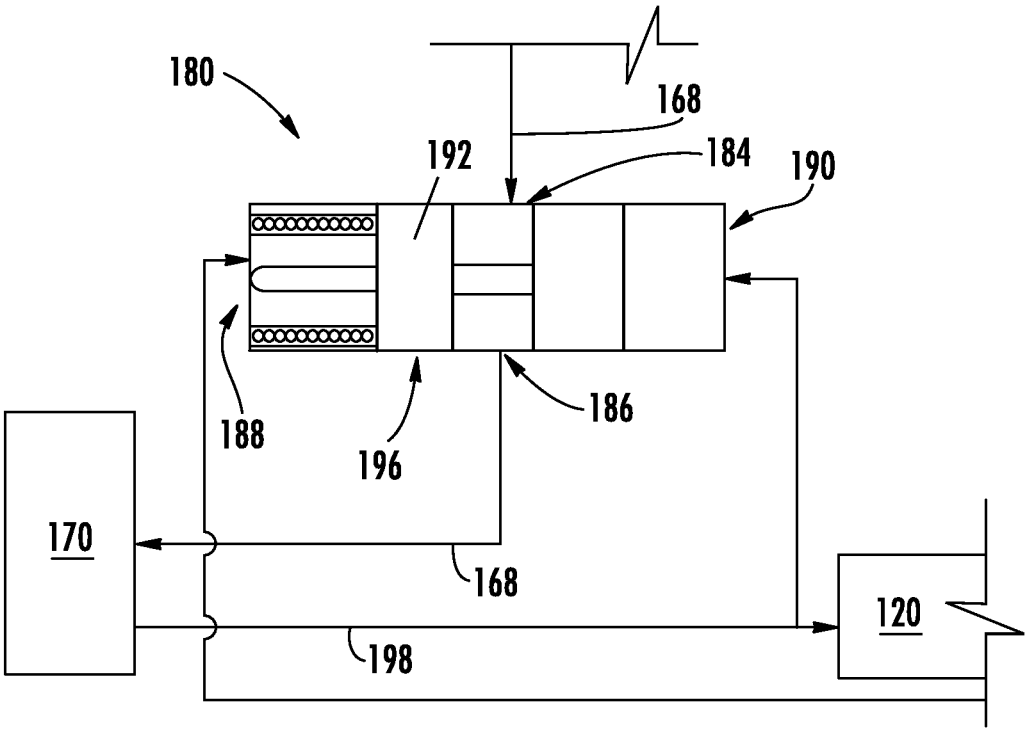
FIG. 4 is a schematic view of the exemplary first return valve of FIG. 3 in an open position.

Referring now also to FIGS. 3 and 4, close-up schematic views of the exemplary first return valve 180 are provided. FIG. 3 depicts the exemplary first return valve 180 in an open position, and FIG. 4 depicts the exemplary first return valve 180 in a closed position. For the embodiment depicted, the first return valve 180 is a spring-loaded hydraulic valve movable to the open position when a pressure differential across the first lubrication supply pump 120 is greater than a predetermined threshold. As stated, when in the open position (FIG. 3), the first return valve 180 allows a flow of fluid through the first return line 168, and when in the closed position (FIG. 4), the first return valve 180 blocks a flow of fluid through the first return line 168.

The first return valve 180 depicted generally includes an inlet 184, an outlet 186, a first reference port 188, a second reference port 190, and a spool 192. The inlet 184 and outlet 186 are each in flow communication with the first return line 168 of the pump 100. During normal operation of the pump 100, lubricant flows through the first return line 168 from the inlet 184 of the first return valve 180 to the outlet 186 of the first return valve 180.

The spool 192 is movable between a first position 194 (FIG. 3) and the second position 196 (FIG. 4). When the spool 192 is in the first position 194, the first return valve 180 is in the open position, and when the spool 192 is in the second position 196, the first return valve 180 is in the closed position. Additionally, the first reference port 188 is fluidly connected to the first lubrication supply line 128 downstream of the first lubrication supply pump 120, and the second reference port 190 is fluidly connected to a first lubrication source line 198 upstream of the first lubrication supply pump 120. When a pressure at the first reference port 188 (i.e. a pressure downstream of the first lubrication supply line 128) is more than a predetermined amount greater than a pressure at the second reference port 190 (i.e. a pressure upstream of the first lubrication supply line 128), the spool 192 is moved to the first position 194 (FIG. 4), such that the first return valve 180 is in the open position. Notably, a pressure differential across the first lubrication supply pump 120 (i.e. a pressure differential between the first reference port 188 and the second reference port 190) being greater than a predetermined threshold indicates that the first lubrication supply pump 120 is operating properly and that the first drive track 102 has not failed.

By contrast, when a pressure differential across the first lubrication supply pump 120 is less than the predetermined threshold, or more particularly, when a pressure differential between the first reference port 188 and the second reference port 190 is less than a predetermined threshold, the spool 192 in the first return valve 180 is moved to the second position 196 (FIG. 4), such that the first return valve 180 is in the closed position. Such indicates that the first lubrication supply pump 120 is not operating properly and that at least a portion of the first drive track 102 has potentially failed. Accordingly, in such a situation, it is desirous to shut off flow to the first plurality of scavenge pumps immediately to allow the still operating scavenge pumps to remove at least a portion of a desired amount of lubrication from the plurality of sumps of the gas turbine engine 10.

Moreover, as is depicted, the valve 180 is biased towards the closed position (FIG. 4) by a biasing member, or more particularly the spool 192 is biased toward the second position 196 by a biasing member. For the embodiment depicted, the biasing member is a spring. Specifically, the spool 192 is biased towards the closed position, such that when, e.g., a pressure differential across the first lubrication supply pump 120 is equal to zero, the first return valve 180 either remains in the closed position, or is moved to the closed position.

Moreover, in certain exemplary embodiments, the second return valve 182 may be configured in substantially the same manner as the first return valve 180 described above with reference to FIGS. 3 and 4. For example, each of the first return valve 180 and the second return valve 182 may be configured as spring loaded hydraulic valves operated based on a pressure differential across the first lubrication supply pump 120 and the second lubrication supply pump 122, respectively. In certain exemplary embodiments, the hydraulic valve configuration is more desirous than a simple check valve, as the hydraulic valve configuration does not create an added pressure loss (as do check valves). An added pressure loss could, in certain exemplary embodiments, cause one drive line of the pump 100 is not prime on start.

It should be appreciated, however, that although for the exemplary embodiment depicted the first return valve 180 and second return valve 182 are each configured as a hydraulic valve, in other exemplary embodiments, one or both of the first return valve 180 or second return valve 182 may have any other suitable configuration.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A pump for a gas turbine engine comprising:

a first drive track including a first driveshaft, a spline, and a first gear, the spline and the first gear each rigidly attached to the first driveshaft;

a second drive track including a second driveshaft and a second gear, the second gear rigidly attached to the second driveshaft and mechanically coupled to the first gear;

a first lubrication supply pump mechanically coupled to the first driveshaft; and a second lubrication supply pump mechanically coupled to the second driveshaft, the first lubrication supply pump and second lubrication supply pump together configured to provide a desired amount of lubricant to the gas turbine engine.

2. The pump of claim 1, wherein the first lubrication supply pump is configured to provide the gas turbine engine up to about half of a desired amount of lubricant, and wherein the second lubrication supply pump is also configured to provide the gas turbine engine up to about half of the desired amount of lubricant.

3. The pump of claim 1, further comprising:

a first scavenge pump mechanically coupled to the first driveshaft; and a second scavenge pump mechanically coupled to the second driveshaft, the first and second scavenge pumps each configured in fluid communication with a sump of the gas turbine engine for removing a desired amount of lubricant from the sump of the gas turbine engine.

4. The pump of claim 1, further comprising:

a first mid scavenge pump mechanically coupled to the first driveshaft and fluidly connected to a first lubrication exit of a mid sump;

a second mid scavenge pump mechanically coupled to the second driveshaft and fluidly connected to a second lubrication exit of the mid sump;

a first AGB scavenge pump mechanically coupled to the first driveshaft and fluidly connected to a first lubrication exit of the AGB;

a second AGB scavenge pump mechanically coupled to the first driveshaft and fluidly connected to the second lubrication exit of the AGB;

a third AGB scavenge pump mechanically coupled to the second driveshaft and fluidly connected to a third lubrication exit of the AGB; and a fourth AGB scavenge pump mechanically coupled to the second driveshaft and fluidly connected to a fourth lubrication exit of the AGB.

5. The pump of claim 1, further comprising:

a first scavenge pump mechanically coupled to the first driveshaft and including an outlet;

a first return line for fluidly connecting the outlet of the first scavenge pump to a tank of the gas turbine engine; and a first return valve positioned in fluid communication with the first return line, the first return valve movable between an open position allowing a flow of fluid through the first return line and a closed position blocking a flow of fluid through the first return line.

6. The pump of claim 5, wherein the first return valve is a hydraulic valve movable to the open position when a pressure differential across the first lubrication supply pump is greater than a predetermined threshold.

7. The pump of claim 1, further comprising:

a first lubrication supply line fluidly connected to the first lubrication supply pump for providing a flow of lubricant from the first lubrication supply pump to the gas turbine engine; and a first check valve positioned in the first lubrication supply line for blocking a flow of lubricant through the first lubrication supply line from the gas turbine engine towards the first lubrication supply pump.

8. The pump of claim 1, wherein the first driveshaft of the first drive track defines a shear section, and wherein the second driveshaft of the second drive track also defines a shear section.

9. The pump of claim 1, wherein the first gear is a first spur gear, and wherein the second gear is a second spur gear.

10. A gas turbine engine comprising:

a compressor section;

a turbine section mechanically coupled to the compressor section; and a pump, the pump including a first drive track including a first driveshaft, a spline, and a first gear, the spline and the first gear each rigidly attached to the first driveshaft;

a second drive track including a second driveshaft and a second gear, the second gear rigidly attached to the second driveshaft and mechanically coupled to the first gear;

a first lubrication supply pump mechanically coupled to the first driveshaft; and a second lubrication supply pump mechanically coupled to the second driveshaft, the first lubrication supply pump and second lubrication supply pump together configured to provide a desired amount of lubricant to the gas turbine engine.

11. The gas turbine engine of claim 10, further comprising a sump positioned at least partially in at least one of the compressor section or turbine section of the gas turbine engine;

a first scavenge pump mechanically coupled to the first driveshaft; and a second scavenge pump mechanically coupled to the second driveshaft, the first and second scavenge pumps each configured in fluid communication with the sump for removing a desired amount of lubricant from the sump.

12. The gas turbine engine of claim 11, wherein the first scavenge pump is configured to remove up to about half of a desired amount of lubricant from the sump, and wherein the second scavenge pump is also configured to remove up to about half of the desired amount of lubricant from the sump.

13. The gas turbine engine of claim 10, wherein the first lubrication supply pump is configured to provide the gas turbine engine up to about half of a desired amount of lubricant, and wherein the second lubrication supply pump is also configured to provide the gas turbine engine up to about half of the desired amount of lubricant.

14. The gas turbine engine of claim 10, further comprising a plurality of sumps positioned in at least one of the compressor section or the turbine section;

a first plurality of scavenge pumps mechanically coupled to the first driveshaft of the first drive track, each of the first plurality of scavenge pumps fluidly connected to one of the plurality of sumps and configured to remove up to about half of a desired amount of lubricant from the respective sump; and a second plurality of scavenge pumps mechanically coupled to the second driveshaft of the second drive track, each of the second plurality of scavenge pumps fluidly connected to one of the plurality of sumps and configured to remove up to about half of the desired amount of lubricant from the respective sump.

15. The gas turbine engine of claim 10, further comprising a first scavenge pump mechanically coupled to the first driveshaft and including an outlet;

a first return line for fluidly connecting the outlet of the first scavenge pump to a tank of the gas turbine engine; and a first return valve positioned in fluid communication with the first return line, the first return valve movable between an open position allowing a flow of fluid through the first return line and a closed position blocking a flow of fluid through the first return line.

16. The gas turbine engine of claim 15, wherein the first return valve is a hydraulic valve movable to the open position when a pressure differential across the first lubrication supply pump is greater than a predetermined threshold.

17. The gas turbine engine of claim 10, further comprising a first lubrication supply line fluidly connected to the first lubrication supply pump for providing a flow of lubricant from the first lubrication supply pump to the gas turbine engine; and a first check valve positioned in the first lubrication supply line for blocking a flow of lubricant through the first lubrication supply line from the gas turbine engine towards the first lubrication supply pump.

18. The gas turbine engine of claim 10, wherein the first driveshaft of the first drive track defines a shear section, and wherein the second driveshaft of the second drive track also defines a shear section.

19. The gas turbine engine of claim 10, wherein the first gear is a first spur gear, and wherein the second gear is a second spur gear.

20. The gas turbine engine of claim 10, wherein the gas turbine engine is an aeronautical gas turbine engine.

* * * * *